United States Patent [19]

Aurand

[11] 4,334,203

[45] Jun. 8, 1982

[54] SECOND HARMONIC SUPPRESSOR FOR POWER AMPLIFIER TANK CIRCUIT

[75] Inventor: James A. Aurand, Quincy, Ill.

[73] Assignee: Broadcast Electronics, Inc., Quincy, Ill.

[21] Appl. No.: 138,668

[22] Filed: Apr. 9, 1980

[51] Int. Cl.[3] ..... H01P 1/212; H01P 7/04

[52] U.S. Cl. ..... 333/226; 330/56; 330/149; 333/176

[58] Field of Search ..... 333/175, 176, 222, 223, 333/224, 226, 206, 207, 202, 204, 205, 219, 235; 331/101; 330/56, 149; 455/114, 124

[56] References Cited

U.S. PATENT DOCUMENTS

| | | | |
|---|---|---|---|
| 1,780,542 | 11/1930 | Schaffer | 455/114 X |
| 1,839,442 | 1/1932 | Schaffer | 455/114 |
| 2,084,740 | 6/1937 | McKesson | 455/114 |
| 2,790,857 | 4/1957 | Gluyas, Jr. et al. | 333/235 X |
| 3,537,041 | 10/1970 | Kommrusch | 333/223 X |
| 4,091,337 | 5/1978 | Heckman, Jr. | 331/101 |
| 4,182,997 | 1/1980 | Brambilla | 333/176 X |

FOREIGN PATENT DOCUMENTS

| | | | |
|---|---|---|---|
| 242693 | 1/1963 | Australia | 331/101 |

*Primary Examiner*—Paul L. Gensler

*Attorney, Agent, or Firm*—Hill, Van Santen, Steadman, Chiara & Simpson

[57] ABSTRACT

A device to suppress the generation of second harmonic frequencies in a power amplifier tank circuit such as may be used in a radio frequency transmitter. The present invention employs a device connected between the outer conductor (which is normally at ground potential) and the inner conductor. Specifically, the device utilizes a metal strap, such as a copper strap, which is connected to the inside surface of the outer conductor in an electrically conductive manner and which is also connected to a capacitor disk movably mounted with respect to the inner conductor. The capacitor disk is mounted to an insulating arm or rod and may be projected back and forth within the space between the outer and inner conductors, thereby adjusting the impedance of the device. By sliding the rod toward the inner conductor, the loop formed by the copper strap becomes more straightened thereby changing the inductance of the circuit. The suppressor is mounted at a point in the tank cavity which is an RF null point for the fundamental frequency. At this point, the second harmonic exhibits a predominantly high impedance and high voltage and thus can be suppressed with this simple LC arrangement.

6 Claims, 5 Drawing Figures

SECOND HARMONIC SUPPRESSOR FOR POWER AMPLIFIER TANK CIRCUIT

BACKGROUND OF THE INVENTION

1. Description of the Prior Art

It is well known in the prior art to remove second harmonic signals generated in a power amplifier resonant transmission line, also referred to as a tank circuit or tank cavity. However, the prior art has removed this undesirable signal in a manner quite different from the teachings of the present invention. Typically, the prior art has utilized the principal of trapping the second harmonic by the use of a second harmonic stub in the RF output line. In addition, such prior art arrangements have utilized low pass filters to further remove second and higher harmonics.

In particular, a typical prior art device may utilize a transmission line stub having a variable short which is adjustable to attenuate the second harmonic. This adjustment is needed to accommodate the selection of the fundamental by tuning within the tank circuit. Such an arrangement is more costly and results in a lower power amplifier efficiency than the present invention.

2. Field of the Invention

The field of art to which this invention pertains is power amplifier tank cavities for generating an RF signal for transmitters and in particular to means for not attenuating but removing the second harmonic of the fundamental generated in such cavities in a manner which maximizes the efficiency of the system.

SUMMARY OF THE INVENTION

It is an important feature of the present invention to provide a second harmonic suppressor for a power amplifier tank circuit.

It is another feature of the present invention to provide a second harmonic suppressor for a power amplifier tank circuit which has improved efficiency, while being less costly to produce.

It is also a feature of the present invention to provide a second harmonic suppressor as described above, which is positioned within the tank cavity at the RF voltage null point for the fundamental frequency.

It is a principal object of the present invention to provide a suppressor for the second harmonic signal in a tank cavity for an RF power amplifier which utilizes an inductive strap coupled from the outer conductor of the cavity to a capacitor element normally positioned adjacent to the inner conductor of the cavity.

It is a further object of the invention to provide a second harmonic suppressor as described above wherein the inductive strap and the capacitor element are adjustably positionable at least in part in the space between the outer conductor and the inner conductor so as to permit optimum suppression of the second harmonic.

These and other objects, features and advantages of the present invention will be understood in greater detail from the following description and the associated drawings wherein reference numerals are utilized to designate a preferred embodiment.

DESCRIPTION OF THE PREFERRED EMBODIMENT

The present invention relates to a second harmonic suppressor for an RF tank circuit of a power amplifier. The device of the present invention improves the efficiency of prior art methods of eliminating second harmonic in similar environments. In the prior art the second harmonic has generally been trapped by the use of a second harmonic stub mounted outside the tank cavity. The second harmonic stub has an adjustable short for tuning to the second harmonic in accordance with the tuning for the fundamental. The present invention utilizes a means for suppressing the generation of second harmonic signals and thereby improves the efficiency of the power amplifier tube and associated tank cavity. It accomplishes this by the use of an LC circuit coupled at least in part within the tank cavity at the voltage null point of the fundamental. At this point, the second harmonic would otherwise exhibit high voltage, but by the use of this LC circuit, the second harmonic is greatly suppressed.

The suppressor circuit of this invention consists of an inductive strap, which is coupled from the outer conductor of the cavity to a capacitor disk which is movably positionable within the space between the outer and inner conductors. The capacitor disk is mounted to an insulating rod, which in turn, is held within a fixture at the outer conductor. The fixture may have a set screw which permits the rod to be moved axially in order to select it's optimum position to suppress the second harmonic.

Figure 1:
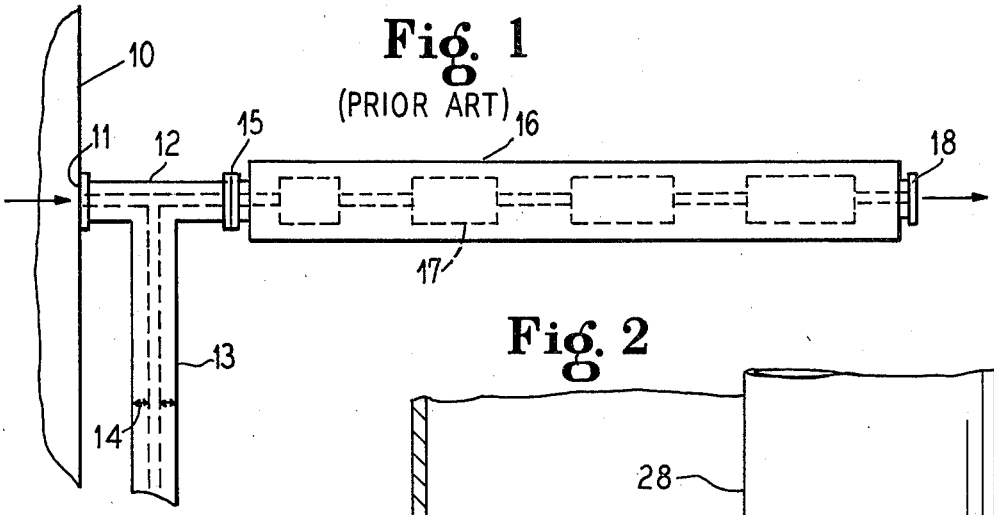
Fig. 1 (PRIOR ART)
FIG. 1 is a view of a prior art transmission line at the output of an RF tank cavity showing a second harmonic trap with an adjustable short and illustrating the use of a low pass filter arrangement prior to passing the signal to an RF output point.

Referring to the drawings in greater detail, FIG. 1 shows a prior art second harmonic trap. The outer conductor of a tank cavity is identified by reference numeral 10. This wall may have an opening at 11 into which a stub transmission line 12 is coupled. The line 12 has a portion 13, which includes an adjustable short 14. By adjusting the position of this short, the stub 12 may be tuned to the second harmonic of the tank cavity.

This second harmonic trap 12 is coupled at a fitting 15 to a low pass filter 16. The filter 16 has filter element 17 which are well understood in the art of transmission lines. The low pass filter is then coupled to an RF output point 18. By the use of such an arrangement, the tank cavity generates second harmonics which take energy from the system. Those second harmonic signals are then shorted out in the second harmonic trap 12 and additionally filtered by the low pass filter 16 prior to the passing of the fundamental signal energy to the RF output point 18.

Figure 2:
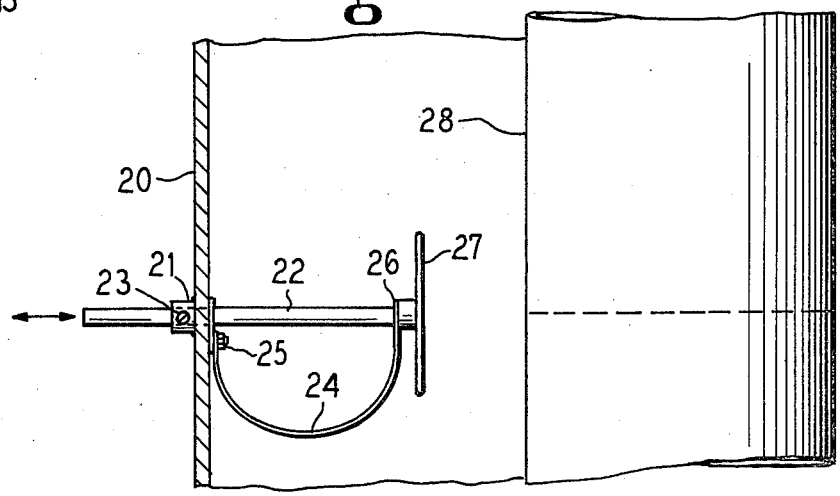
FIG. 2 diagramatically illustrates the second harmonic suppressor of the present invention where the inductive strap is coupled to the outer conductor of the cavity and a capacitor disk together with the strap are adjustably movable relative to the outer surface of the inner conductor and being at the voltage null point for the fundamental frequency.
Figure 3:
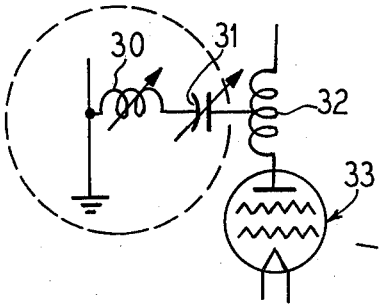
FIG. 3 is an equivalent circuit for the suppressor of the present invention showing the LC arrangement inside the circle, the inductance being variable as the insulating rod (FIG. 2) is moved in and out of its mounting means at the outer conductor.
Figure 4:
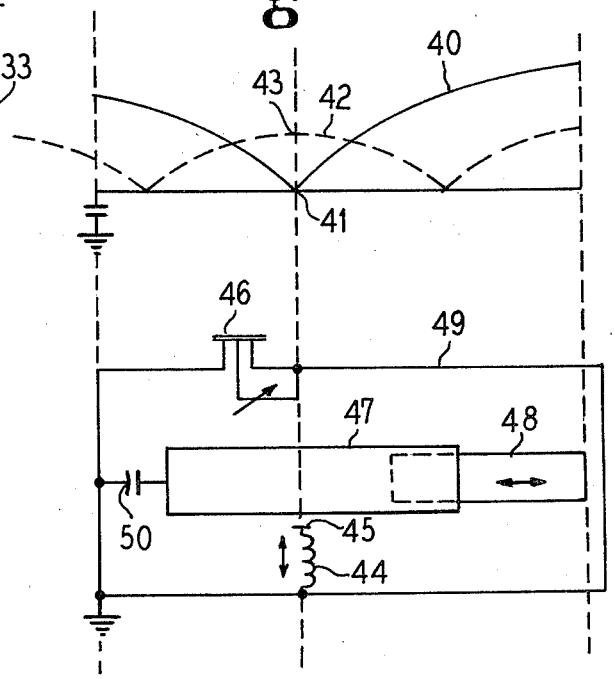
FIG. 4 diagramatically illustrates the voltage waveforms for the fundamental and second harmonic frequencies relative to the length of the RF tank cavity, showing that the fundamental frequency is at a null point where the second harmonic is at a point of high impedance, this being the location of the suppressor of the present invention.

The suppressor of the present invention is shown in FIGS. 2 and 3 and is further schematically depicted in FIG. 4.

In FIG. 2, the wall 20 of an outer conductor is shown in part. A fitting 21 is fastened to an opening in the wall to permit an insulating rod 22 to be slidably mounted therein. The fitting 21 has a set screw 23, which may be loosened or tightened to permit the rod 22 to be moved to a desired adjustment point and then locked in place. An inductive strap 24 is electrically and mechanically coupled to the wall 20 at a point 25 and is also coupled at its opposite end 26 to the rod 22, such that the strap forms a loop between its ends. A capacitor disk 27 is mounted to the outer end of the rod 22, so that it and the conductive strap 24 can form an inductive-capacitive circuit. The conductive strap 24 may, for example, be of $\frac{5}{8}''$ wide copper. The inner conductor is shown at 28, and the second harmonic being suppressed may be selected by moving the rod 22. The inner conductor 28 comprises a half-wave length section which may be of any of the types shown in my co-pending patent application entitled "POWER AMPLIFIER RF TANK CIRCUIT" Ser. No. 138,669 filed of even date herewith.

FIG. 3 shows an equivalent circuit for the device of FIG. 2. The inductance 30 and the capacitor 31 are the equivalents of the conductive strap 24 and the capacitor disk 27. The coil 32 represents the inner conductor 28, and a power amplifier tube is shown schematically at 33. This suppressor circuit is connected in the cavity to an RF voltage null point of the fundamental frequency and accordingly, acts as a suppressor to the generation of second harmonic signals without disturbing the fundamental.

The voltage waveforms for the fundamental and second harmonic are shown in FIG. 4 for a half-wave tuning cavity. The fundamental 40 has a voltage null point at a location 41, and at the same location, a second harmonic 42 exhibits high impedance and high voltage as shown by 43. A suppressor circuit of the present invention as described above is further illustrated in FIG. 4 by numerals 44 and 45. The tank cavity of FIG. 4 includes an inner conductor 47, a tuning means 48, and an outer conductor 49. A power amplifier tube represented by its output capacity 50 is located between the inner conductor and the grounded outer conductor, and an RF output or takeoff loop is shown at 46.

Figure 5:
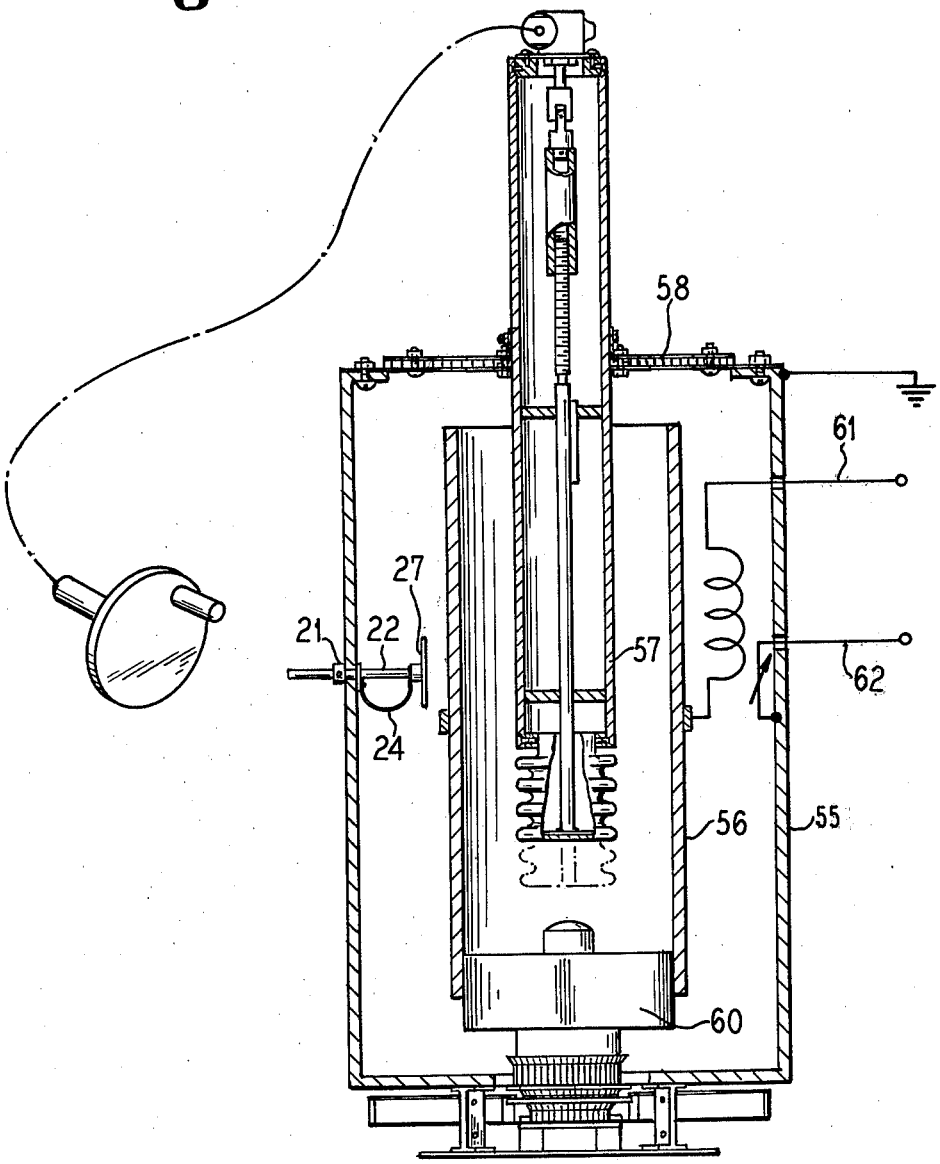
FIG. 5 is a folded half-wave cavity as shown in my co-pending patent application entitled "POWER AMPLIFIER RF TANK CIRCUIT", Ser. No. 138,669, showing the positioning of a second harmonic suppressor therein.

FIG. 5 shows the suppressor mounted in the wall of a folded half-wave cavity of the type described in detail in my above mentioned co-pending patent application. This cavity has an outer conductor 55, an inner conductor 56 and a third conductor 57. The third conductor 57 is electrically connected to the outer conductor 55 by a sandwiched plate structure shown at 58 creating a folded effect. The suppressor of this invention is particularly adaptable to a folded cavity of this type, since this cavity has an available voltage null point at which the suppressor may be physically positioned. In this cavity the power amplifier tube is shown at 60, the supply voltage is shown at 61, and the output signal frequency takeoff is at 62.

It will be understood that various modifications of the above described invention may be accomplished by those persons skilled in the art, without departing from the novel features revealed herein and set forth in the attached claims.

I claim as my invention:

1. The combination of a power amplifier resonant transmission line having an outer conductor and an inner conductor, and a second harmonic suppressor therefor comprising:

a capacitive plate and an inductive strap;

the inductive strap being mechanically and electrically coupled from the outer conductor to the capacitive plate; and means for adjusting the position of said capacitive plate with respect to said inner conductor.

2. The combination in accordance with claim 1 wherein said capacitive and inductive devices are positioned approximately at a voltage null point for the fundamental operating frequency of said resonant transmission line.

3. In a resonant transmission line for a power amplifier tube, the combination of:

an inner conductor and an outer conductor;

an inductive strap electrically coupled to said outer conductor and having a portion forming at least a partial loop within the space between said inner and outer conductors;

an adjustable insulating arm mounted in said resonant transmission line and carrying said partial loop therein;

a capacitive means supported by said adjustable arm and electrically connected to said inductive strap;

means permitting the movement of said adjustable insulating arm toward and away from said inner conductor to thereby vary the electrical impedance formed by said inductive strap and capacitive means at the second harmonic of the operating frequency of said resonant transmission line; and said partial loop and capacitive means being positioned at a voltage null point for the operating frequency of the resonant transmission line.

4. The combination of claim 3 wherein said partial loop of said inductive strap is electrically connected at one end to said outer conductor and at the other end to said insulating arm;

said strap being suspended between its ends to form said partial loop;

said arm being extensible perpendicularly to the axis of said inner conductor for simultaneously varying the configuration of said loop and the position of said capacitibe means;

whereby adjustment of said arm permits selection of the optimum impedance for suppression of the second harmonic of the fundamental operating frequency.

5. The combination of claim 4 further comprising a means for lockably positioning said arm within said outer conductor after an optimum position for suppression of the second harmonic is achieved.

6. The combination of claim 4 wherein said capacitive means is a plate carried at an end of said arm between said conductors.

* * * * *